US012366160B2

(12) United States Patent
Machocki

(10) Patent No.: US 12,366,160 B2
(45) Date of Patent: Jul. 22, 2025

(54) SYSTEM AND METHOD FOR STREAMING HIGH FREQUENCY DATA TO SURFACE WHILE DRILLING

(71) Applicant: SAUDI ARABIAN OIL COMPANY, Dhahran (SA)

(72) Inventor: Krzysztof Karol Machocki, Aberdeen (GB)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/466,772

(22) Filed: Sep. 13, 2023

(65) Prior Publication Data

US 2025/0084761 A1 Mar. 13, 2025

(51) Int. Cl.
*E21B 47/12* (2012.01)
*E21B 41/00* (2006.01)

(52) U.S. Cl.
CPC ..... *E21B 47/12* (2013.01); *E21B 41/0085* (2013.01)

(58) Field of Classification Search
CPC ..... E21B 47/12; E21B 47/125; E21B 47/13; E21B 47/135; E21B 41/0085; E21B 23/14; E21B 47/16; E21B 47/18; E21B 47/20; E21B 47/22; E21B 47/24; E21B 47/14; E21B 47/138
See application file for complete search history.

(56) References Cited

U.S. PATENT DOCUMENTS 6,170,573 B1 1/2001 Brunet et al.
2005/0087368 A1* 4/2005 Boyle ..... E21B 17/0283 175/57

(Continued)

FOREIGN PATENT DOCUMENTS

CA 3171244 A1 12/2015
WO 2020212742 A1 10/2020

OTHER PUBLICATIONS

International Search Report issued in corresponding International Application No. PCT/US2024/045963; mailed Jan. 30, 2025 (6 pages).

(Continued)

*Primary Examiner* — Yanick A Akaragwe
(74) *Attorney, Agent, or Firm* — Osha Bergman Watanabe & Burton LLP

(57) ABSTRACT

A system and method include a dart deployment sub coupled to a drill string including a data receiver, a transmission device, and a data transmission cable, a downhole data collection sub coupled downhole from the dart deployment sub including an instrumentation package capable of acquiring parameter data regarding a location in the wellbore, and a dart disposed inside the dart deployment sub coupled to the data transmission cable configured to receive acquired parameter data from the downhole data collection sub. The dart is configured to depart from the dart deployment sub and land in the downhole data collection sub, wherein the data receiver is configured to receive parameter data from the dart via the data transmission cable. The system further includes a surface collection device coupled to the transmission device configured to transmit parameter data from the dart deployment sub to the surface collection device.

18 Claims, 7 Drawing Sheets

(56) References Cited

U.S. PATENT DOCUMENTS

| | | | | |
|---|---|---|---|---|
| 2010/0116550 | A1* | 5/2010 | Hutin | E21B 47/13 340/853.1 |
| 2011/0079401 | A1* | 4/2011 | Gambier | E21B 23/08 166/117.6 |
| 2013/0133883 | A1 | 5/2013 | Hill, Jr. | |
| 2015/0167449 | A1* | 6/2015 | Rodney | E21B 47/06 166/385 |
| 2016/0021578 | A1 | 1/2016 | Bostick et al. | |
| 2019/0010803 | A1 | 1/2019 | Purkis | |
| 2020/0332651 | A1 | 10/2020 | Jacob et al. | |
| 2021/0238979 | A1 | 8/2021 | Stokely et al. | |

OTHER PUBLICATIONS

Written Opinion of the International Searching Authority issued in corresponding International Application No. PCT/US2024/045963; dated Jan. 30, 2025 (7 pages).

* cited by examiner

SYSTEM AND METHOD FOR STREAMING HIGH FREQUENCY DATA TO SURFACE WHILE DRILLING

BACKGROUND

In the oil and gas industry, there are two types of systems that allow streaming of high-frequency data from downhole tools to surface during drilling. Both systems are expensive to implement and uneconomical for land drilling operations. Other systems are available for streaming solely low-frequency data, however, those systems have environmental limitations. Consequently, the majority of high-frequency downhole data that is being recorded downhole is not transmitted to surface. Due to the time lag of recording and analyzing the data, the opportunity to optimize drilling activities while drilling is missed. Furthermore, reasons for drilling issues are only discovered after pulling the tools up to surface, thereby increasing time, cost, and danger.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a system for a drill string in a wellbore comprising: a dart deployment sub coupled to the drill string comprising a data receiver, a transmission device, and a data transmission cable; a downhole data collection sub coupled to the drill string downhole from the dart deployment sub comprising an instrumentation package capable of acquiring parameter data regarding a first location in the wellbore; dart disposed inside the dart deployment sub coupled to the data transmission cable configured to receive acquired parameter data from the downhole data collection sub, the dart configured to depart from the dart deployment sub and land in the downhole data collection sub, wherein the data receiver is configured to receive parameter data from the dart via the data transmission cable; and a surface collection device coupled to the transmission device, the transmission device configured to transmit parameter data from the dart deployment sub to the surface collection device.

In one aspect, embodiments disclosed herein relate to a method for a drill string in a wellbore comprising: conveying a downhole data collection sub coupled to the drill string and a dart deployment sub coupled to the drill string uphole from the downhole data collection sub in the wellbore; deploying, via the dart deployment sub, a dart disposed inside the dart deployment sub coupled to a data transmission cable to land in the downhole data collection sub; acquiring parameter data regarding a first location in the wellbore, via an instrumentation package in the downhole data collection sub; receiving acquired parameter data, via the data transmission cable, from the dart to a data receiver in the dart deployment sub; and transmitting received parameter data, via a transmission device in the dart deployment sub, to a surface collection device.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
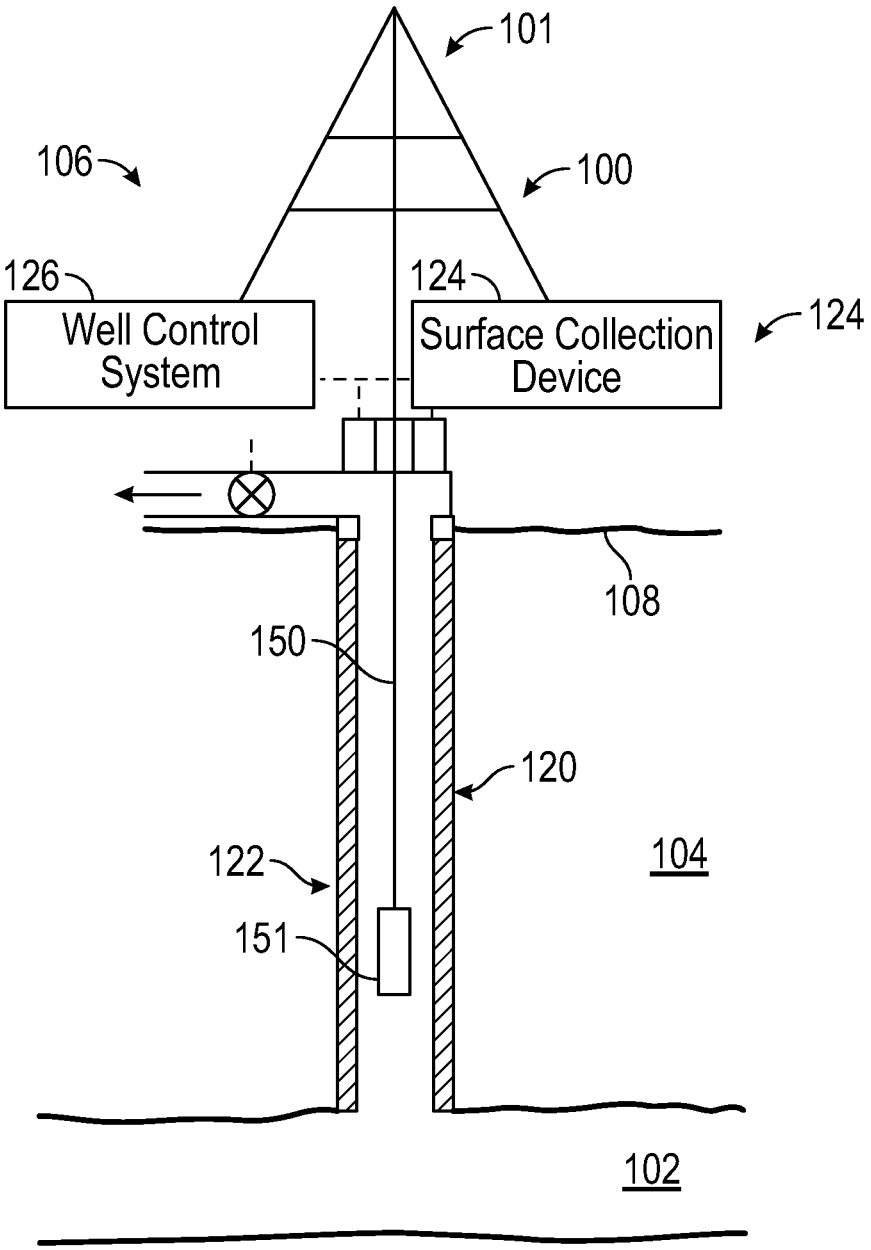
FIG. 1 shows a schematic diagram in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before," "after." "single," and other such terminology. Rather, the use of ordinal numbers is to distinguish between the elements. By way of an example, a first element is distinct from a second element, and the first element may encompass more than one element and succeed (or precede) the second element in an ordering of elements.

In the following description of FIGS. 1-6, any component described regarding a figure, in various embodiments disclosed herein, may be equivalent to one or more like-named components described with regard to any other figure. For brevity, descriptions of these components will not be repeated regarding each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

It is to be understood that the singular forms "a," "an," and "the" include plural referents unless the context clearly dictates otherwise. Thus, for example, reference to "a force applicator" includes reference to one or more of such force applicators.

In one aspect, embodiments disclosed herein relate to systems and methods for streaming high-frequency data from downhole tools to the surface during drilling operations. The streaming system is coupled to various parts of a drill string in a well and on surface. High-frequency data may refer to data measured and downloaded in real-time.

Embodiments of the present disclosure may provide at least one of the following advantages. The streaming system allows for low energy usage and low-cost operations that enable high-frequency data transmission over a long distance in challenging drilling conditions. The streaming system includes a downhole data collection sub and dart deployment sub. The downhole data collection sub is capable of collecting data from integrated sensors or other downhole tools, such as Measure While Drilling (MWD) and Logging While Drilling (LWD) tools. The downhole data collection sub is capable of catching a dart from the dart deployment sub and streaming the data to the dart via a wired or wireless connection. The data is then transmitted from the dart through a data transmission cable and dart deployment sub to a surface collection device.

FIG. 1 shows a schematic diagram in accordance with one or more embodiments. As shown in FIG. 1, a well environment (100) includes a subterranean formation ("formation") (104) and a well system (106). The formation (104) may include a porous or fractured rock formation that resides underground, beneath the surface of the earth or beneath a seabed ("surface") (108). The formation (104) may include different layers of rock having varying characteristics, such as varying degrees of permeability, porosity, capillary pressure, and resistivity. In the case of the well system (106) being a hydrocarbon well, the formation (104) may include a hydrocarbon-bearing reservoir (102) (hereafter "reservoir"). In the case of the well system (106) being operated as a production well, the well system (106) may facilitate the extraction of hydrocarbons (or "production") from the reservoir (102).

In some embodiments disclosed herein, the well system (106) includes a rig (101), a wellbore (120), a well subsurface system (122), a well surface system (124), a well control system (126), and a surface collection device (160). The well control system (126) may control various operations of the well system (106), such as well production operations, well drilling operations, well completion operations, well maintenance operations, and reservoir monitoring, assessment, and development operations.

The rig (101) is the machine used to drill a borehole to form the wellbore (120) by rotating a drilling bit. The drill bit may be referred to as a "bit." The wellbore (120) may be vertical, inclined, and/or horizontal. Major components of the rig (101) include the drilling fluid tanks, the drilling fluid pumps (e.g., rig mixing pumps), the derrick or mast, the draw works, the drill string (150), the power generation equipment and auxiliary equipment. A key component of the rig (101) may include a well component (134) for providing rotation and torque to the drill bit. A few key advantages to rotating the drill string (150) may include reduced drag, improved hole cleaning, and faster drilling. The well component (134) may be on surface (108) or downhole. The well component (134) on surface (108) may be a rotary table or top drive. The rig (101) may be replaced with a Coiled Tubing Unit and require drilling fluid and mud motors/turbines as the well component (134) to generate rotation for the drill bit.

Drilling fluid, also referred to as "drilling mud" or simply "mud," is used to facilitate drilling boreholes into the earth, such as drilling oil and natural gas wells. The main functions of drilling fluids include providing hydrostatic pressure to prevent formation fluids from entering into the borehole, keeping the drill bit cool and clean during drilling, carrying out drill cuttings, and suspending the drill cuttings while drilling is paused and when the drilling assembly is brought in and out of the borehole. Drilling mud may be a source for power generation in downhole tools, such as motors. The drilling mud may be used to drive downhole motors or turbines to provide extra rotation per minute (RPM) to the drill bit. The drilling mud may be used for directional control enabling the wellbore (120) to be steered in a particular direction.

The wellbore (120) includes the borehole that extends from the surface (108) towards a target zone of the formation (104), such as the reservoir (102). An upper end of the wellbore (120), terminating at or near the surface (108), may be referred to as the "uphole" end of the wellbore (120), and a lower end of the wellbore, terminating in the formation (104), may be referred to as the "downhole" end of the wellbore (120). The wellbore (120) may facilitate the circulation of the drilling fluids during drilling operations for the wellbore (120) to extend towards the target zone of the formation (104) (e.g., the reservoir (102)), facilitate the flow of hydrocarbon production (e.g., oil and gas) from the reservoir (102) to the surface (108) during production operations, facilitate the injection of substances (e.g., water) into the formation (104) or the reservoir (102) during injection operations, or facilitate the communication of monitoring devices (e.g., logging tools) lowered into the formation (104) or the reservoir (102) during monitoring operations (e.g., during in situ logging operations).

In one or more embodiments, the well system (106) is provided with a well sub-surface system (122) with a bottom hole assembly (BHA) (151) attached to the drill string (150) made of drill pipes to suspend into the wellbore (120) for performing the well drilling operation. The BHA (151) is the lowest part of the drill string (150) and includes the drill bit, drill collar, stabilizer, etc. Weight is applied to the drill bit by components in the BHA (151). The BHA (151) may be in compression while the rest of the drill string (150) is in tension. Applying weight to the drill bit at high inclinations may become an issue without a tool to aid in weight transfer.

Figure 6:
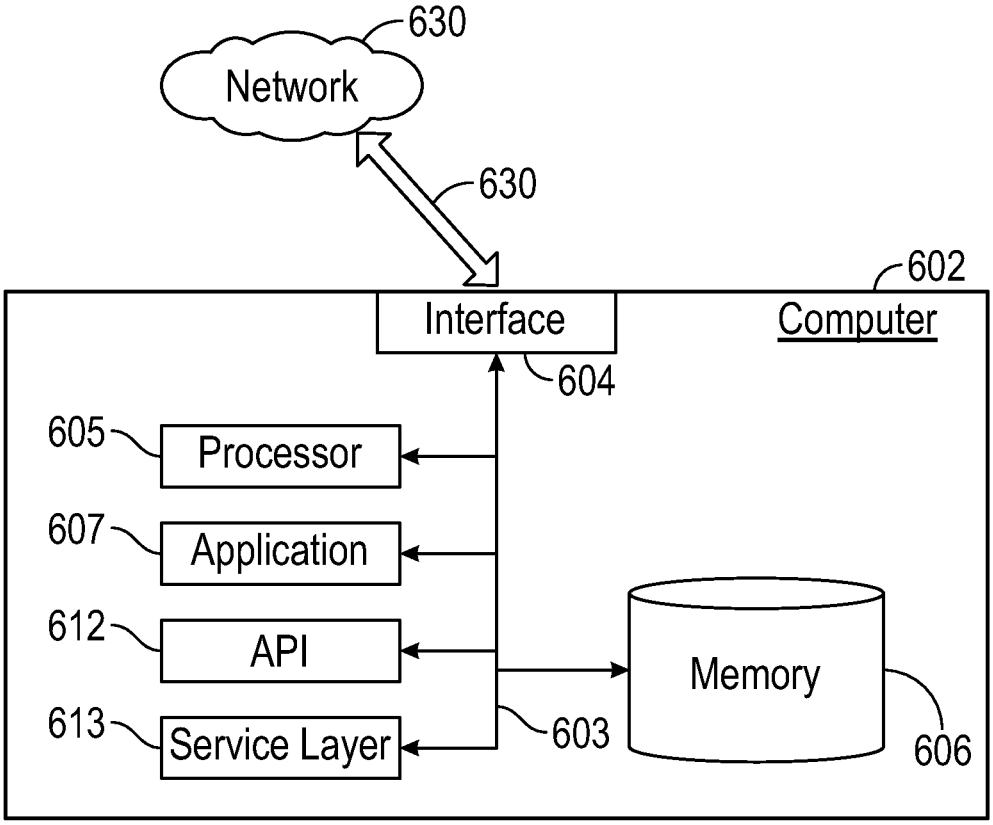
FIG. 6 shows a computer system in accordance with one or more embodiments.

In one or more embodiments, the surface collection device (160) is located on surface (108) of the well system (106). The surface collection device (160) may be any device capable of acquiring data wirelessly or via a cable. The surface collection device (160) may allow a user to read downhole data at surface. In one or more embodiments, the surface collection device (160) may be a computer system as depicted in FIG. 6, which will be described in greater detail later in the disclosure.

Figure 2:
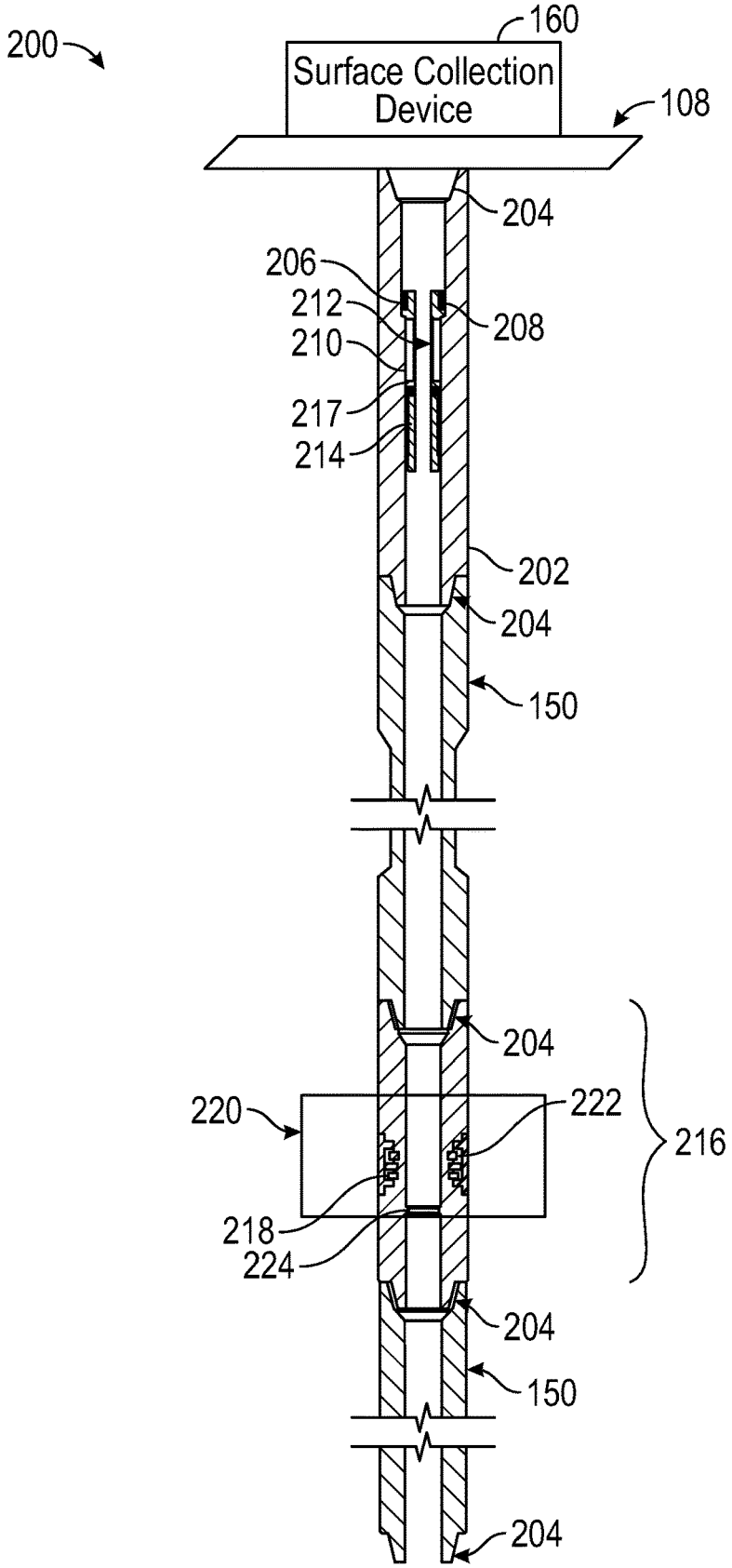
FIG. 2 shows a streaming system in accordance with one or more embodiments.

FIG. 2 shows a streaming system (200) implemented in a drill string in accordance with one or more embodiments. The streaming system (200) may be conveyed into the wellbore (120). Specifically, FIG. 2 shows the streaming system (200) not deployed. The streaming system (200) includes a dart deployment sub (202) coupled to the drill string (150) and a dart (214). The dart deployment sub (202) may be made of pipe material. One skilled in the art may appreciate that the dart deployment sub (202) may be coupled to the drill string (150) or other downhole tools using a connection (204) such as a thread. The dart deployment sub (202) may be located downhole or on surface (108). The dart deployment sub (202) may be surface deployed. The dart deployment sub (202) includes a data receiver (206), a transmission device (208), and a data transmission cable (210) fitted inside. The dart deployment sub (202) may include a spool (212) on a dedicated reel for coiling and uncoiling the data transmission cable (210). FIG. 2 illustrates the data transmission cable (210) coiled on the spool (212) when the streaming system (200) is not deployed. The data receiver (206) may include a data communication module on the spool (212) end of the dart deployment sub (202) connected to the data transmission cable (210). When deployed, the data transmission cable (210) may be capable of connecting two subs that are spaced apart by a long distance, such as 1 kilometers (km) to 15 km, to transmit data.

The dart deployment sub (202) may accommodate one dart (214) inside of itself. FIG. 2 illustrates the dart (214) disposed inside of the dart deployment sub (202) and coupled to the data transmission cable (210). The dart (214) may be installed inside the dart deployment sub (202) before the dart deployment sub (202) is attached to the drill string (150). Alternatively, the dart (214) may be placed inside the dart deployment sub (202) after the dart deployment sub (202) is attached to the drill string (150). In such instances, the dart (214) may be placed using a connection (204) uphole from the dart deployment sub (202) or a special opening made within the dart deployment sub (202), (not shown in FIGS.). The dart (214) is configured to deploy from the dart deployment sub (202). The dart deployment sub (202) may be actuated and deploy the dart (214) to a downhole data collection sub (216). The dart (214) may include a data receiving device (217) to allow the dart (214) to receive parameter data.

The streaming system (200) further includes the downhole data collection sub (216) coupled to the drill string (150) downhole from the dart deployment sub (202). For example, a part of the drill string (150) may be between the downhole data collection sub (216) and the dart deployment sub (202). In some embodiments, FIG. 2 illustrates part of the drill string (150) downhole from the downhole data collection sub (216) coupled to the BHA (151) and drill bit using a connection (204). A person of ordinary skill in the art may appreciate that the downhole data collection sub (216) may be sub-positioned in a strategic location. Candidate strategic locations may include but is not limited to directly uphole from a drill bit, downhole or uphole from drill collars, in between drill pipes on the drill string (150), and between downhole tools in the BHA (151). Downhole BHA (151) tools include underreamers, roller reamers, motors, rotary steerable system (RSS) tools, stabilizers, anti-stick tools, slip tools, etc. The downhole data collection sub (216) may be installed in the drill string (150) while running pipe in the wellbore (120).

The downhole data collection sub (216) includes an instrumentation package (218) capable of measuring and acquiring parameter data. Parameter data may include any mechanical operating data related to the downhole environment, such as but not limited to axial and lateral pipe vibrations, torque, tension, compression, drag, temperature, pressure, fluid flow, flow rate, pipe bending, outer diameter, and etc. Parameter data may include measurements inside and outside the pipe of the drill string (150). Parameter data may be collected by the downhole data collection sub (216) at a first location (220) of the instrumentation package (218). The instrumentation package (218) may include one or more integrated sensors.

The downhole data collection sub (216) may be capable of recording and tracking mechanical parameters of a drilling assembly, such as the drill string (150). The instrumentation package (218) may further measure geological and directional data. The sensors in the instrumentation package (218) may be utilized to identify any unexpected downhole behavior that may contribute to loss of energy along the drill string (150) or premature destruction or damage of drill string (150) components. The downhole data collection sub (216) may be self-powered by a battery. Alternatively, the downhole data collection sub (216) may generate energy downhole by field-proven energy harvesting methods, such as used by a fluid turbine. In other embodiments, power may be delivered from the surface (108) by a cable connected to the dart (214) via the dart deployment sub (202) when deployed.

In the embodiment shown in FIG. 2, the downhole data collection sub (216) is not capable of transmitting the parameter data to surface when the streaming system (200) is not deployed. In some embodiments, the downhole data collection sub (216) is capable of collecting data from downhole tools, such as but not limited to Measure While Drilling and Logging While Drilling tools. In some embodiments, the downhole data collection sub (216) includes a data transmission module (222) discussed in more detail below when the streaming system (200) is deployed.

The downhole data collection sub (216) may further include a dart catcher sub (224) configured to catch the dart (214) when deployed. The dart catcher sub (224) may be disposed in the BHA (151) or integrated in the downhole data collection sub (216). The downhole data collection sub (216) may be coupled to parts of the drill string (150) on both ends of the downhole data collection sub (216). The downhole data collection sub (216) may be utilized in a memory mode or a data transmission mode. The memory mode includes recording data to an internal memory. The data transmission mode includes transmitting data to a receiving device, such as the dart (214). The downhole data collection sub (216) may be capable of recording data even when data is streamed to the dart (214). Alternatively, the downhole data collection sub (216) may only be capable of streaming data and not recording. The downhole data collection sub (216) may be capable of stopping data recording while streaming the data to surface (108).

The streaming system (200) further includes the surface collection device (160) on the surface (108). The surface collection device (160) is coupled to the dart deployment sub (202) through the transmission device (208). The surface collection device (160) may include a display for a user to access and read data. The surface collection device (160) is capable of receiving communications from the dart deployment sub (202) or any downhole tool coupled to the streaming system (200). The surface collection device (160) may be capable of downloading and storing data.

Figure 3A:
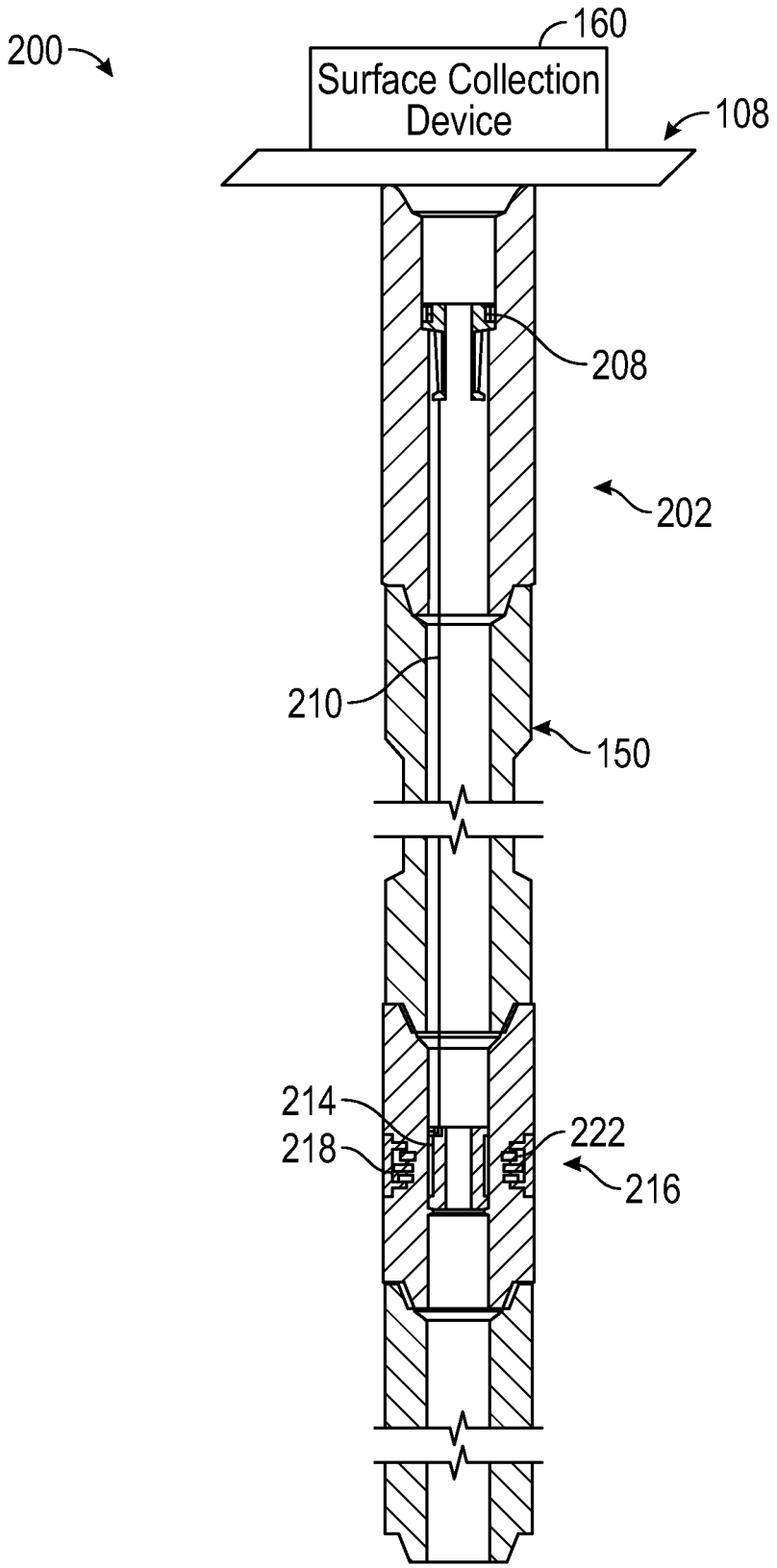
FIGS. 3A-3C show the streaming system deployed in accordance with one or more embodiments.
Figure 3B:
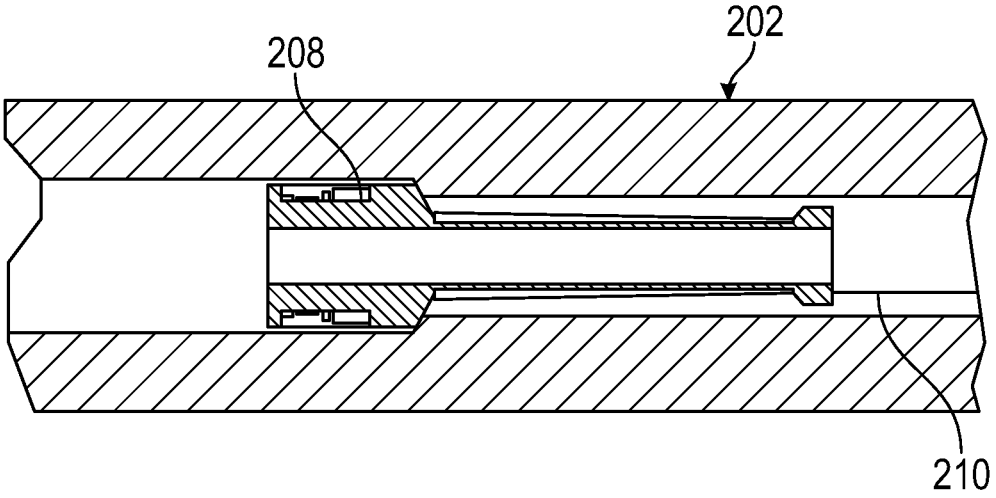
Figure 3C:
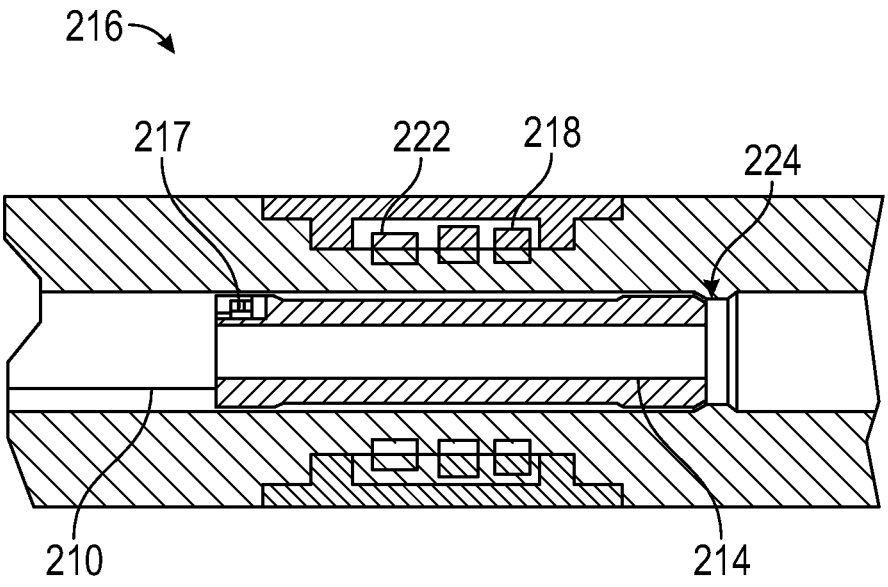

FIGS. 3A-3C show the streaming system (200) deployed in accordance with one or more embodiments. Turning to FIG. 3A, the dart (214) has departed from the dart deployment sub (202) into the drill string (150) and landed in the downhole data collection sub (216). The data transmission cable (210) is still connected between the dart (214), spool (212), and transmission device (208). In such instance, the data transmission cable (210) attached to the dart (214) uncoils from the spool (212) so that the dart (214) may reach the downhole data collection sub (216). The dart (214) is capable of collecting, receiving, and transmitting data.

The downhole data collection sub (216) acquires parameter data measured by the instrumentation package (218). In some embodiments, the downhole data collection sub (216) streams the collected parameter data to the dart (214) via a wired or wireless connection as the dart (214) lands in the downhole data collection sub (216) or dart catcher sub (224) if present. Using the data transmission module (222), the dart (214) may receive data from the downhole data collection sub (216) wirelessly over a short distance when the dart (214) is in contact with the downhole data collection sub (216). In some embodiments, physical contact between the dart (214) and the data transmission module (222) may aid in data transmission and energy conservation during data communication. In embodiments where a dart catcher sub (224) is present, the dart (214) may receive data from the dart catcher sub (224) wirelessly over a short distance using the data transmission module (222) in the downhole data collection sub (216). For example, if the dart (214) is in the downhole data collection sub (216) or dart catcher sub (224), the dart (214) may communicate and receive data from the downhole data collection sub (216) or dart catcher sub (224) through the data transmission module (222).

The data transmission module (222) may be any standard wireless technique available and suitable for a downhole environment, such as acoustic telemetry, electromagnetic telemetry, pressure pulse telemetry, and other wireless telemetries capable of transmitting data over a short distance, such as around 10 meters. Alternatively, the dart (214) may include a dedicated connector capable of latching to a corresponding connector in the downhole data collection sub (216) or dart catcher sub (224). In such embodiments, data may be transmitted through a wired connection between the dedicated connector and the corresponding connector, therefore, not requiring any wireless communication.

The collected parameter data in the dart (214) may then be transmitted through the data transmission cable (210) to the data receiver (206) in the dart deployment sub (202). The dart deployment sub (202) is capable of receiving data from the dart (214) and transmitting data to the surface collection device (160) using the transmission device (208). The transmission device (208) may be bolted to the dart deployment sub (202) to allow a wireless or wired data transmission at the surface (108). The surface collection device (160) may be coupled to the transmission device (208) wirelessly or with a cable. For example, data may be transmitted wirelessly over a short distance, such as up to 1 km or more, or transmitted via a wired connection or cable with designated connectors to the dedicated surface collection device (160). A user may utilize the data collected by the surface collection device (160) to perform data analytic tasks for drilling optimization.

In one or more embodiments, the dart (214) may be made of a dissolvable material, such as magnesium. The dart (214) may dissolve within the downhole data collection sub (216) or dart catcher sub (224) after receiving and transmitting data from the downhole data collection sub (216) through the data transmission cable (210) to the dart deployment sub (202). In other embodiments, the dart (214) may include a rapturing disc fitted inside. The rapture disc may rupture after receiving and transmitting data from the downhole data collection sub (216) to the dart deployment sub (202), thereby restoring an original internal diameter within the drill string (150) without the dart (214). Alternatively, the dart (214) may be capable of disconnecting the data transmission cable (210) to allow the data transmission cable (210) to be recoiled onto the spool (212) and pulled up to the surface (108).

In one or more embodiments, the dart deployment sub (202) requires low power to receive and transmit data over a short distance. In such embodiments, power may be delivered by standard methods used in the oil and gas industry for downhole tools, such as batteries or flow turbine power generators. Alternatively, data may be downloaded from the dart deployment sub (202) by connecting an electronic device, such as a laptop or tablet to the dart deployment sub (202) not requiring any power. For example, the dart deployment sub (202) may act as an extension lead to connect the downhole data collection sub (216) to a dedicated external device to display the data. In other embodiments, the dart deployment sub (202) may be powered by an external source, such as an external battery pack, an external power cable, an external data cable capable of transmitting power, or an external device, such as a personal computing device (PC), that will deliver power and download data simultaneously.

Turning to FIG. 3B, FIG. 3B illustrates a close view of the dart deployment sub (202) with the dart (214) deployed. FIG. 3B shows the transmission device (208) inside the dart deployment sub (202).

Turning to FIG. 3C, FIG. 3C illustrates a close view of the downhole data collection sub (216) with the dart (214) inside the downhole data collection sub (216) after being deployed and landing in the dart catcher sub (224). The dart (214) may include a data receiving device (217) capable of receiving data from the instrumentation package (218) of the downhole data collection sub (216) to transmit through the data transmission cable (210).

Figure 4A:
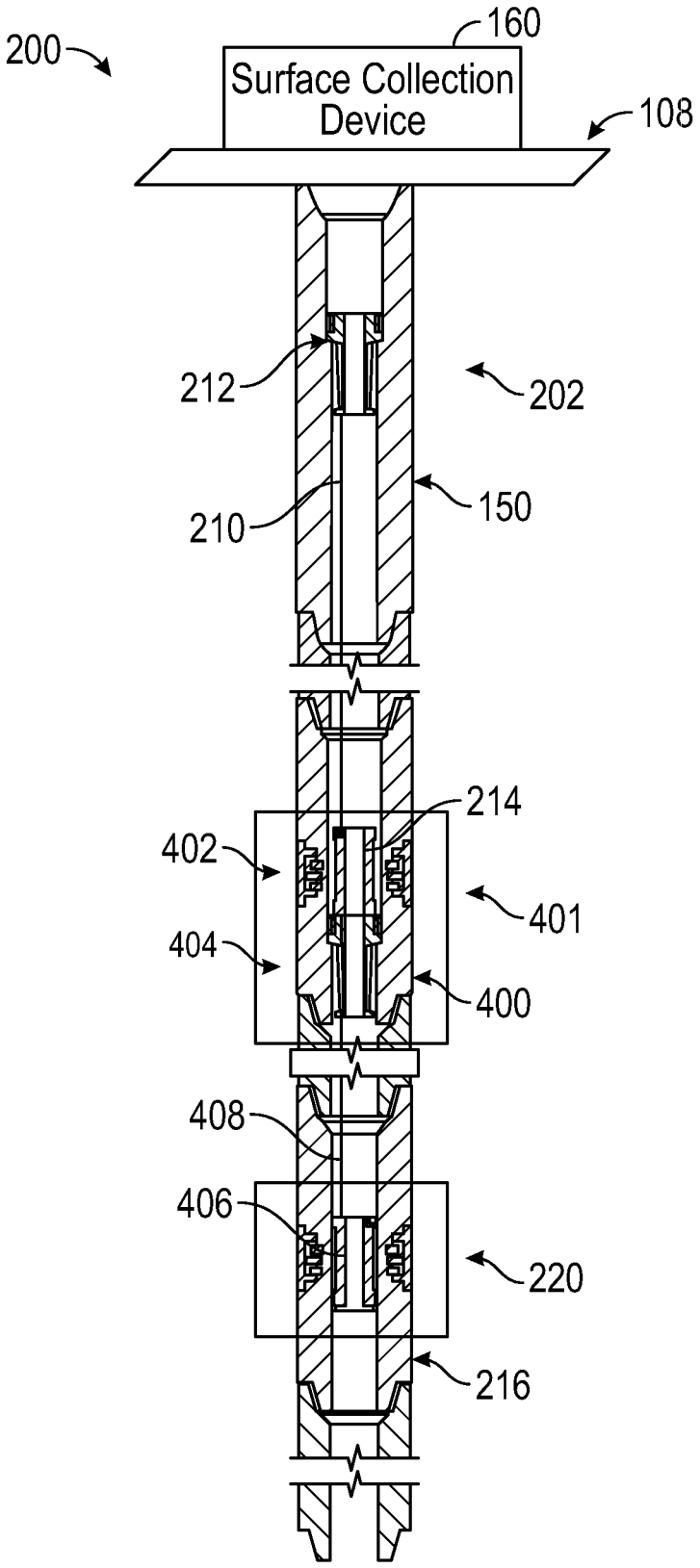
FIGS. 4A and 4B show a streaming system in accordance with one or more embodiments.
Figure 4B:
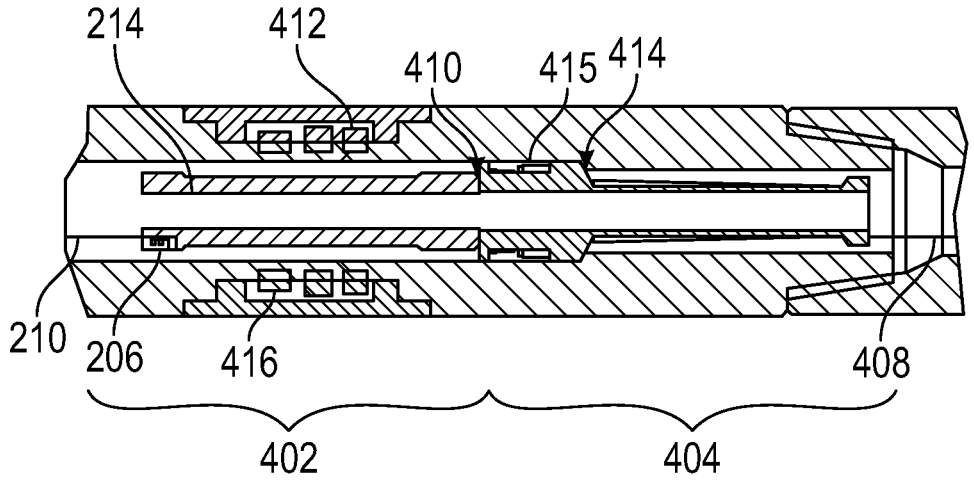

FIGS. 4A and 4B show a streaming system (200) in accordance with one or more embodiments. The streaming system (200) may include a collection and extension sub (400). Specifically, the streaming system (200) shown in FIGS. 4A and 4B is deployed. The streaming system (200) may include a downhole data collection sub (216) and at least one collection and extension sub (400) placed in strategic locations, such as behind the drill bit, and in drill pipes. Turning to FIG. 4A, the collection and extension sub (400) may be coupled to the drill string (150) between the dart deployment sub (202) and the downhole data collection sub (216). The collection and extension sub (400) may allow for multiple data collection points along the streaming system (200). The collection and extension sub (400) includes a second downhole data collection sub (402) coupled uphole to a second dart deployment sub (404). The second dart deployment sub (404) includes a second dart (406) inside. For example, the streaming system (200) shown in FIG. 4A illustrates two darts, a first dart (e.g., dart (214)) deployed from the dart deployment sub (202) and a second dart (406) deployed from the second dart deployment sub (404) in the collection and extension sub (400).

The dart (214) departs from the dart deployment sub (202) coupled to the data transmission cable (210) and lands inside the second downhole data collection sub (402) in the collection and extension sub (400). The second dart (406) departs from the second dart deployment sub (404) inside the collection and extension sub (400) coupled to a second data transmission cable (408) and lands inside the downhole data collection sub (216). Parameter data regarding the first location (220) of the instrumentation package (218) acquired from the downhole data collection sub (216) is received by the second dart (406) and transmitted to the collection and extension sub (400) through the second data transmission cable (408). The collection and extension sub (400) receives the parameter data transmitted by the second dart (406) via the second dart deployment sub (404).

FIG. 4B shows an expanded view of the collection and extension sub (400) with the dart (214) inside and the second dart (406) deployed. The dart (214) may land in a second dart catcher sub (410) inside the second downhole data collection sub (402). The collection and extension sub (400) acquires parameter data regarding a second location (401) of a second instrumentation package (412) inside the second downhole data collection sub (402). The second downhole data collection sub (402) may then transmit the parameter data regarding the second location (401) using a second data transmission module (416). The second dart (406) is deployed to land in the downhole data collection sub (216) and receives parameter data regarding the first location (220). The second dart (406) deploys coupled to the second data transmission cable (408) from a second spool (414) disposed in the second dart deployment sub (404).

Once the dart (214) lands in the second downhole data collection sub (402), the dart (214) may receive parameter data regarding the first location (220) to the data receiver (206) through a second transmission device (415) inside the second dart deployment sub (404). The dart (214) may also receive parameter data regarding the second location (401) via the data receiver (206) in the dart (214). The dart (214) transmits the parameter data regarding both the first location (220) and the second location (401) through the data transmission cable (210) to the dart deployment sub (202). The dart deployment sub (202) transmits the parameter data to the surface collection device (160) on surface (108).

In some embodiments, multiple collection and extension subs (400) may be used in the streaming system (200). Multiple collection and extension subs (400) may be fitted into the drill string (150). Connections made between the collection and extension subs (400) from the one most uphole on the drill string (150) to the one most downhole on the drill string (150) to the downhole data collection sub (216). The collection and extension subs (400) may be connected with a designated cable inside the pipe with the downhole data collection sub (216) or a previously fitted collection and extension sub (400). The last installed collection and extension sub (400) may be capable of catching the dart (214) from the dart deployment sub (202) on surface (108) and stream parameter data to the dart (214).

In such embodiments, some of the collection and extension subs (400) may have different instrumentation packages (218) or none at all. Different instrumentation packages (218) may include different types of sensors collecting different types of data. Some of the collection and extension subs (400) may be operating in different modes such as data recording mode only, constant data transmitting mode, and/or memory type only mode. Data recording mode only refers to streaming data only when prompted by a user on surface (108). Constant data transmitting mode refers to continuous data transmission when a dart is deployed. Memory type only mode refers to data recording with no streaming.

Figure 5:
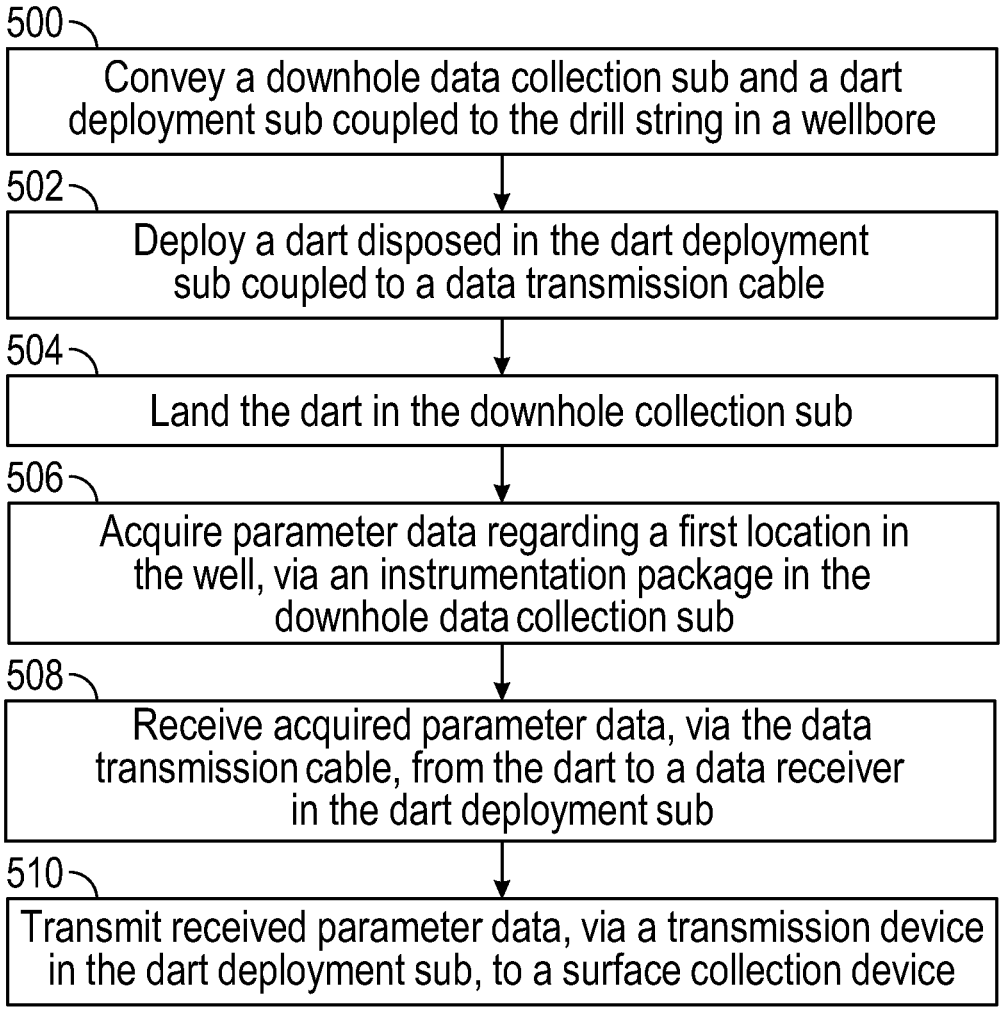
FIG. 5 shows a flowchart in accordance with one or more embodiments.

FIG. 5 shows a flowchart in accordance with one or more embodiments. Specifically, FIG. 5 describes a general method for a streaming system for a drill string in a wellbore in accordance with one or more embodiments. One or more blocks in FIG. 5 may be performed by one or more components (e.g., streaming system (200)) as described in FIGS. 1-4. While the various blocks in FIG. 5 are presented and described sequentially, one or ordinary skill in the art will appreciate that some or all of the blocks may be executed in different orders, may be combined or omitted, and some or all of the blocks may be executed in parallel. Furthermore, the blocks may be performed actively or passively.

In Block 500, a downhole data collection sub and a dart deployment sub coupled to the drill string are conveyed in the well. The dart deployment sub is coupled to the drill string uphole from the downhole data collection sub. The dart deployment sub may be surface deployed. In Block 502, a dart disposed in the dart deployment sub coupled to a data transmission cable is deployed. The dart is deployed via the dart deployment sub to land in the downhole data collection sub (Block 504). The dart may land in a dart catcher sub disposed inside the downhole data collection sub if present. When the dart deploys, the data transmission cable may uncoil from a spool disposed in the dart deployment sub to a length from the dart deployment sub to the downhole data collection sub. Uncoiling the data transmission cable may accommodate a length between 50 meters to 12 kilometers while still connected to the dart deployment sub and dart. The dart may travel towards the downhole data collection sub due to gravity, not requiring fluid circulation. Alternatively, the dart may be pushed towards the downhole data collection sub using mud pumps which pump drilling fluid inside the drill string during drilling activities. Once, the dart lands inside the downhole data collection sub, the connection between the dart deployment sub and the downhole data collection sub is formed.

In Block 506, parameter data regarding a first location in the well is acquired via an instrumentation package in the downhole data collection sub. The instrumentation package may include a plurality of sensors capable of measuring parameter data. The downhole data collection sub may be self-powered by a battery. The downhole data collection sub may generate energy using a harvesting method similar to a turbine harvesting method. In Block 508, the acquired parameter data is received from the dart to a data receiver in the dart deployment sub via the data transmission cable. In Block 510, the received parameter data is transmitted to a surface collection device via a transmission device in the dart deployment sub. Parameter data recorded by the downhole collection sub may be downloaded by the surface collection device within minutes, depending on the quality of cable and connections. The transmission device may be coupled to the surface collection device wirelessly or with a cable. The drill string along with all the elements, such as the downhole data collection sub, may be retrieved from the wellbore once drilling activities stop. If the drill string is removed, the data transmission cable may require recoiling on surface by a tool used to remove the cable. The data transmission cable may also be cut and disposed of during removal of drill string or pulling out-of-hole activity if the data transmission cable is disposable.

In one or more embodiments, once the dart lands inside the downhole data collection sub or the collection and extension sub, an indication of the landing is sent to the surface. The indication may be achieved by the increase of pressure due to the dart blocking fluid passage around the downhole data collection sub. Alternatively, the dart may generate a signal to confirm landing to surface. The dart may be left connected to the downhole data collection sub during drilling and after transmitting data to the surface collection device. Alternatively, the dart may be disconnected, retrieved to the surface, or left in the wellbore in a designated dart catcher sub. The dart deployment sub may be removed from the drill string at any point and drilling activities may continue.

In some embodiments, the downhole data collection sub may capture and record parameter data during drilling activities before installing the dart deployment sub. In such embodiments, the parameter data will not be streamed to surface in real-time until the dart deployment sub is connected at the surface to the drill string and the dart is deployed.

In alternative embodiments, additional parameter data regarding multiple locations may be measured and transmitted by installing one or more collection and extension subs coupled to the drill string between the dart deployment sub and the downhole data collection sub. In some embodiments, multiple collection and extension subs may be used in the drill string. A dart deployment sub may be considered a collection and extension sub if another dart deployment sub is installed in the drill string with an additional dart to connect the new dart deployment sub with the original dart deployment sub, with or without any sensors or instrumentation package. All collection and extension subs are connected together in the same manner as the streaming system described in FIGS. 4A and 4B. In embodiments involving a collection and extension sub, a first dart coupled to a data transmission cable from the dart deployment sub may deploy and land in the collection and extension sub. A second dart disposed inside the collection and extension sub coupled to a second data transmission cable may deploy and land in the downhole data collection sub. Parameter data regarding the first location of the downhole data collection sub and a second location of the collection and extension sub may be received by each dart and transmitted through the data transmission cables and to the dart deployment sub. The dart deployment sub may then transmit all the collected parameter data regarding the first and second location to the surface collection device using the transmission device.

In the oil and gas industry, one or more downhole tools capable of actuation, such as changing position from one state to another, may be installed in the drill string and connected to one or more downhole data collection sub or collection and extension sub. The downhole tools may include but is not limited to circulation subs, reamers, under-reamers, disconnection subs. The downhole tools may be actuated in a variety of industry known methods, such as ball drop, dart actuators, radiofrequency identification (RFID) actuation, mud pulse, or wired pipe. The downhole tools may communicate, transmit, and receive commands to change their state or send data to the downhole data collection sub or surface via the dart.

Embodiments may be implemented on a computer system. FIG. 6 is a block diagram of a computer system (602) used to provide computational functionalities associated with described algorithms, methods, functions, processes, flows, and procedures as described in the instant disclosure, according to an implementation. The illustrated computer (602) is intended to encompass any computing device such as a high performance computing (HPC) device, a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (602) may include a computer that includes an input device, such as a keypad, keyboard, touch screen, or other device that can accept user information, and an output device that conveys information associated with the operation of the computer (602), including digital data, visual, or audio information (or a combination of information), or a GUI.

The computer (602) can serve in a role as a client, network component, a server, a database or other persistency, or any other component (or a combination of roles) of a computer system for performing the subject matter described in the instant disclosure. The illustrated computer (602) is communicably coupled with a network (630). In some implementations, one or more components of the computer (602) may be configured to operate within environments, including cloud-computing-based, local, global, or other environment (or a combination of environments).

At a high level, the computer (602) is an electronic computing device operable to receive, transmit, process, store, or manage data and information associated with the described subject matter. According to some implementations, the computer (602) may also include or be communicably coupled with an application server, e-mail server, web server, caching server, streaming data server, business intelligence (BI) server, or other server (or a combination of servers).

The computer (602) can receive requests over network (630) from a client application (for example, executing on another computer (602)) and responding to the received requests by processing the said requests in an appropriate software application. In addition, requests may also be sent to the computer (602) from internal users (for example, from a command console or by other appropriate access method), external or third-parties, other automated applications, as well as any other appropriate entities, individuals, systems, or computers.

Each of the components of the computer (602) can communicate using a system bus (603). In some implementations, any or all of the components of the computer (602), both hardware or software (or a combination of hardware and software), may interface with each other or the interface (604) (or a combination of both) over the system bus (603) using an application programming interface (API) (612) or a service layer (613) (or a combination of the API (612) and service layer (613). The API (612) may include specifications for routines, data structures, and object classes. The API (612) may be either computer-language independent or dependent and refer to a complete interface, a single function, or even a set of APIs. The service layer (613) provides software services to the computer (602) or other components (whether or not illustrated) that are communicably coupled to the computer (602). The functionality of the computer (602) may be accessible for all service consumers using this service layer. Software services, such as those provided by the service layer (613), provide reusable, defined business functionalities through a defined interface. For example, the interface may be software written in JAVA, C++, or other suitable language providing data in extensible markup language (XML) format or other suitable format. While illustrated as an integrated component of the computer (602), alternative implementations may illustrate the API (612) or the service layer (613) as stand-alone components in relation to other components of the computer (602) or other components (whether or not illustrated) that are communicably coupled to the computer (602). Moreover, any or all parts of the API (612) or the service layer (613) may be implemented as child or sub-modules of another software module, enterprise application, or hardware module without departing from the scope of this disclosure.

The computer (602) includes an interface (604). Although illustrated as a single interface (604) in FIG. 5, two or more interfaces (604) may be used according to particular needs, desires, or particular implementations of the computer (602). The interface (604) is used by the computer (602) for communicating with other systems in a distributed environment that are connected to the network (630). Generally, the interface (includes logic encoded in software or hardware (or a combination of software and hardware) and operable to communicate with the network (630). More specifically, the interface (604) may include software supporting one or more communication protocols associated with communications such that the network (630) or interface's hardware is operable to communicate physical signals within and outside of the illustrated computer (602).

The computer (602) includes at least one computer processor (605). Although illustrated as a single computer processor (605) in FIG. 5, two or more processors may be used according to particular needs, desires, or particular implementations of the computer (602). Generally, the computer processor (605) executes instructions and manipulates data to perform the operations of the computer (602) and any algorithms, methods, functions, processes, flows, and procedures as described in the instant disclosure.

The computer (602) also includes a memory (606) that holds data for the computer (602) or other components (or a combination of both) that can be connected to the network (630). For example, memory (606) can be a database storing data consistent with this disclosure. Although illustrated as a single memory (606) in FIG. 5, two or more memories may be used according to particular needs, desires, or particular implementations of the computer (602) and the described functionality. While memory (606) is illustrated as an integral component of the computer (602), in alternative implementations, memory (606) can be external to the computer (602).

The application (607) is an algorithmic software engine providing functionality according to particular needs, desires, or particular implementations of the computer (602), particularly with respect to functionality described in this disclosure. For example, application (607) can serve as one or more components, modules, applications, etc. Further, although illustrated as a single application (607), the application (607) may be implemented as multiple applications (607) on the computer (602). In addition, although illustrated as integral to the computer (602), in alternative implementations, the application (607) can be external to the computer (602).

There may be any number of computers (602) associated with, or external to, a computer system containing computer (602), each computer (602) communicating over network (630). Further, the term "client," "user," and other appropriate terminology may be used interchangeably as appropriate without departing from the scope of this disclosure. Moreover, this disclosure contemplates that many users may use one computer (602), or that one user may use multiple computers (602).

In some embodiments, the computer (602) is implemented as part of a cloud computing system. For example, a cloud computing system may include one or more remote servers along with various other cloud components, such as cloud storage units and edge servers. In particular, a cloud computing system may perform one or more computing operations without direct active management by a user device or local computer system. As such, a cloud computing system may have different functions distributed over multiple locations from a central server, which may be performed using one or more Internet connections. More specifically, cloud computing system may operate according to one or more service models, such as infrastructure as a service (IaaS), platform as a service (PaaS), software as a service (SaaS), mobile "backend" as a service (MBaaS), serverless computing, artificial intelligence (AI) as a service (AIaaS), and/or function as a service (FaaS).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112 (f) for any limitations of any of the claims herein, except for those in which the claim expressly uses the words 'means for' together with an associated function.

What is claimed is:

1. A streaming system for a drill string in a wellbore, comprising:

a dart deployment sub coupled to the drill string comprising a data receiver fitted inside the dart deployment sub, a transmission device fitted inside the dart deployment sub, and a data transmission cable fitted inside the dart deployment sub;

a downhole data collection sub coupled to the drill string downhole from the dart deployment sub comprising an instrumentation package capable of acquiring parameter data regarding a first location in the wellbore;

a dart disposed inside the dart deployment sub coupled to the data transmission cable configured to receive acquired parameter data from the downhole data collection sub, the dart configured to depart from the dart deployment sub and land in the downhole data collection sub, wherein the data receiver is configured to receive parameter data from the dart via the data transmission cable; and a surface collection device coupled to the transmission device, the transmission device configured to transmit parameter data from the dart deployment sub to the surface collection device, wherein the dart deployment sub comprises a spool configured to coil and uncoil the data transmission cable to a length from the dart deployment sub to the downhole data collection sub.

2. The system of claim 1, further comprising:

a collection and extension sub coupled to the drill string between the dart deployment sub and the downhole data collection sub, the collection and extension sub comprising a second downhole data collection sub coupled uphole to a second dart deployment sub having a second dart inside the second dart deployment sub, and wherein the dart disposed inside the dart deployment sub departs from the dart deployment sub and lands in the second downhole data collection sub, wherein the second dart is configured to depart from the second dart deployment sub and land in the downhole data collection sub.

3. The system of claim 2, wherein the second downhole data collection sub comprises a second instrumentation package capable of acquiring parameter data regarding a second location in the wellbore, and wherein the second dart deployment sub comprises a second data receiver configured to receive parameter data from the first location via a second data transmission cable coupled to the second dart, wherein the dart deployment sub is configured to receive parameter data from the data receiver and the second data receiver via the dart and transmit parameter data to the surface collection device via the transmission device.

4. The system of claim 1, wherein the dart deployment sub is surface deployed.

5. The system of claim 1, wherein the surface collection device is coupled to the transmission device wirelessly or with a cable.

6. The system of claim 1, wherein the downhole data collection sub is self-powered by a battery.

7. The system of claim 1, wherein the downhole data collection sub is configured to generate energy using a harvesting method.

8. The system of claim 1, wherein the instrumentation package comprises a plurality of sensors configured to measure parameter data.

9. The system of claim 1, wherein the dart is configured to land in a dart catcher sub disposed in the downhole data collection sub.

10. A streaming method for a drill string in a wellbore, comprising:

conveying a downhole data collection sub coupled to the drill string and a dart deployment sub coupled to the drill string uphole from the downhole data collection sub in the wellbore;

deploying, via the dart deployment sub, a dart disposed inside the dart deployment sub coupled to a data transmission cable fitted inside the dart deployment sub to land in the downhole data collection sub;

acquiring parameter data regarding a first location in the wellbore, via an instrumentation package in the downhole data collection sub;

receiving acquired parameter data, via the data transmission cable, from the dart to a data receiver fitted inside the dart deployment sub; and transmitting received parameter data, via a transmission device fitted inside the dart deployment sub, to a surface collection device, wherein deploying the dart comprises uncoiling the data transmission cable from a spool in the dart deployment sub to a length from the dart deployment sub to the downhole data collection sub.

11. The method of claim 10, further comprising:

coupling a collection and extension sub to the drill string between the dart deployment sub and the downhole data collection sub, the collection and extension sub comprising a second downhole data collection sub coupled uphole to a second dart deployment sub having a second dart inside the second dart deployment sub, wherein deploying the dart comprises deploying the dart from the dart deployment sub and landing in the second downhole data collection sub; and deploying, via the second dart deployment sub, a second dart disposed inside the second dart deployment sub coupled to a second data transmission cable to land in the downhole data collection sub.

12. The method of claim 11, further comprising:

acquiring parameter data comprises acquiring parameter data regarding a second location in the wellbore, via a second instrumentation package in the second downhole data collection sub; and receiving acquired parameter data comprises receiving acquired parameter data from the data receiver regarding the second location and from a second data receiver regarding the first location, wherein the second data receiver is disposed in the second dart deployment sub coupled to a second data transmission cable coupled to the second dart.

13. The method of claim 10, wherein the dart deployment sub is surface deployed.

14. The method of claim 10, wherein transmitting received parameter data comprises coupling the transmission device to the surface collection device wirelessly or with a cable.

15. The method of claim 10, wherein the downhole data collection sub is self-powered by a battery.

16. The method of claim 10, wherein the instrumentation package comprises a plurality of sensors configured to measure parameter data.

17. The method of claim 10, wherein the downhole data collection sub is configured to generate energy using a harvesting method.

18. The method of claim 10, wherein the dart is configured to land in a dart catcher sub disposed inside the downhole data collection sub.

* * * * *